US007832564B2

(12) United States Patent
Kim

(10) Patent No.: US 7,832,564 B2
(45) Date of Patent: Nov. 16, 2010

(54) COSMETICS CASE HAVING STRUCTURE OF DUAL SEAL

(75) Inventor: Seung-Il Kim, Seoul (KR)

(73) Assignee: Nest Filler PKG Co., Ltd. (KR)

( * ) Notice: Subject to any disclaimer, the term of this patent is extended or adjusted under 35 U.S.C. 154(b) by 216 days.

(21) Appl. No.: 12/296,755

(22) PCT Filed: Jan. 30, 2008

(86) PCT No.: PCT/KR2008/000551

§ 371 (c)(1),
(2), (4) Date: Oct. 10, 2008

(87) PCT Pub. No.: WO2008/100025

PCT Pub. Date: Aug. 21, 2008

(65) Prior Publication Data

US 2009/0272399 A1 Nov. 5, 2009

(30) Foreign Application Priority Data

Feb. 13, 2007 (KR) ..... 10-2007-0014725

(51) Int. Cl.
*A45D 33/00* (2006.01)

(52) U.S. Cl. ..... 206/581; 206/823; 132/293; 132/300; 220/DIG. 26

(58) Field of Classification Search ..... 206/225, 206/235, 581, 823; 220/378, DIG. 10; 132/293, 132/294, 295, 296, 297, 300
See application file for complete search history.

(56) References Cited

U.S. PATENT DOCUMENTS 5,896,866 A * 4/1999 Quennessen ..... 132/293
6,173,719 B1 * 1/2001 Petit ..... 132/294
6,345,627 B1 * 2/2002 Petit ..... 132/293
6,923,335 B2 * 8/2005 Fujita et al. ..... 220/291
7,393,115 B2 * 7/2008 Tokushita et al. ..... 362/136
7,464,820 B2 * 12/2008 Oh ..... 206/581

(Continued)

FOREIGN PATENT DOCUMENTS

JP 08-242937 9/1996

(Continued)

OTHER PUBLICATIONS

International Search Report, Application No. PCT/KR2008/000551, dated May 27, 2008.

*Primary Examiner*—David T Fidei
(74) *Attorney, Agent, or Firm*—Cantor Colburn LLP

(57) ABSTRACT

A cosmetics case having a dual sealing structure is disclosed. The cosmetic case includes an outer case (1), an inner case (10), an inner lid (30), a rail case (20), and an outer lid (40). The outer case has a receiving chamber and a fastening groove. The inner case is received in the receiving chamber such that its fastening step is inserted into the fastening groove, and has a packing groove to receive a packing. A plurality of locking guides is provided on the outer circumference of the inner case. The inner lid is rotated around a second hinge pin, thus opening or closing the inner case, and the lower end of the inner lid comes into close contact with the packing. The rail case is mounted on the outer case. The outer lid includes projections that are guided along the corresponding locking guides.

3 Claims, 3 Drawing Sheets

U.S. PATENT DOCUMENTS

| | | | | |
|---|---|---|---|---|
| 2002/0124863 | A1* | 9/2002 | Gueret | 132/293 |
| 2006/0151355 | A1* | 7/2006 | Oh | 206/581 |
| 2007/0029226 | A1* | 2/2007 | Yuhara et al. | 206/581 |

FOREIGN PATENT DOCUMENTS

| | | |
|---|---|---|
| JP | 09-028452 | 2/1997 |
| JP | 09-037838 | 2/1997 |
| KR | 10-2005-0032459 | 4/2005 |
| KR | 20-0431983 | 11/2006 |

* cited by examiner

【Figure 1】
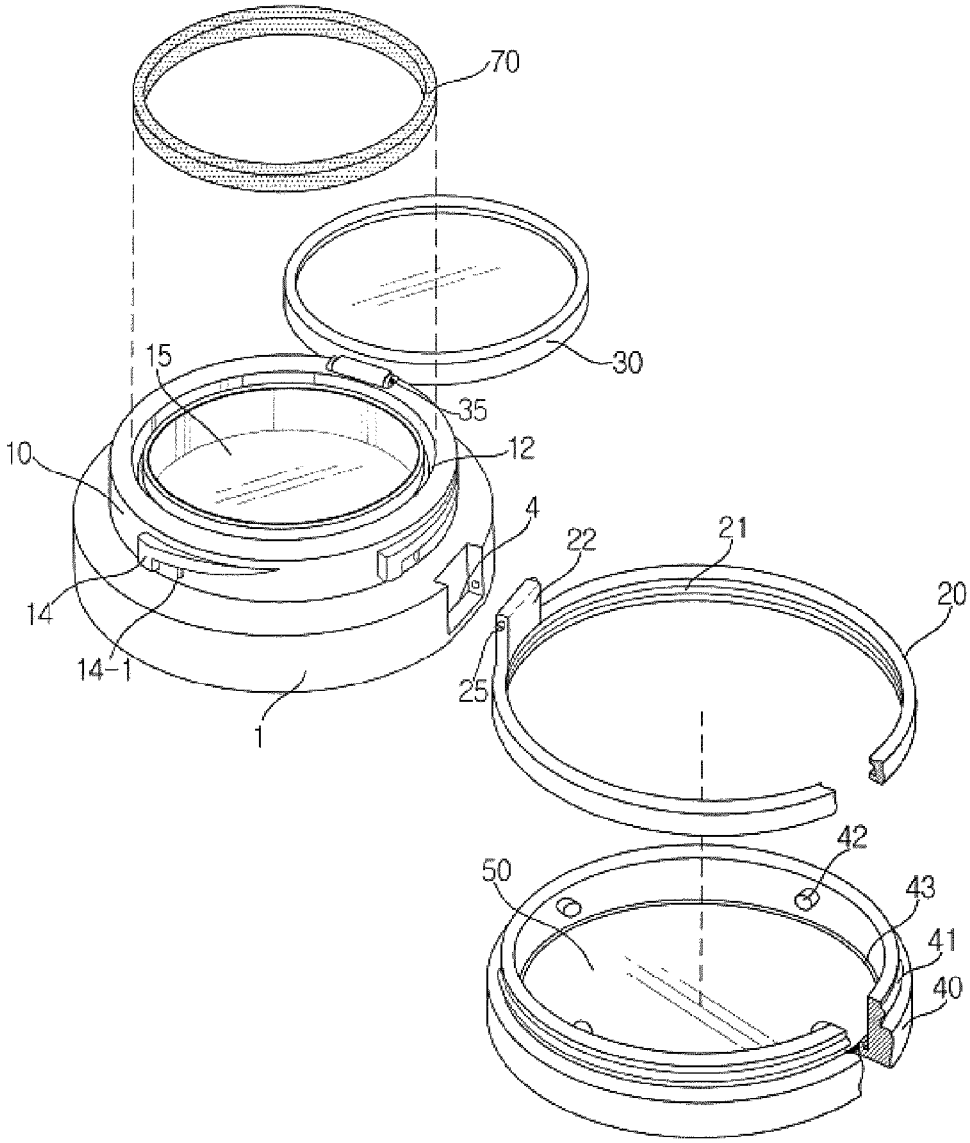

【Figure 2】
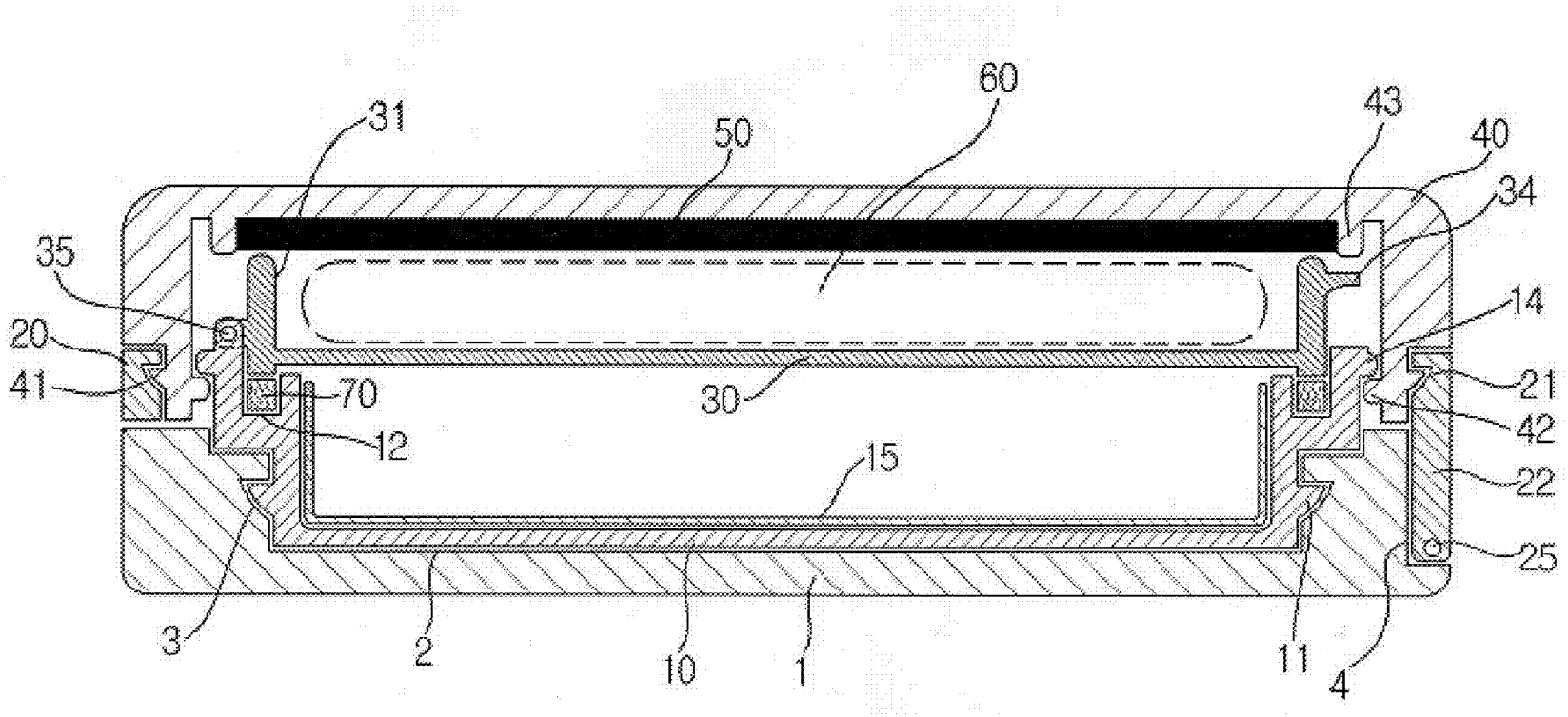

【Figure 3】
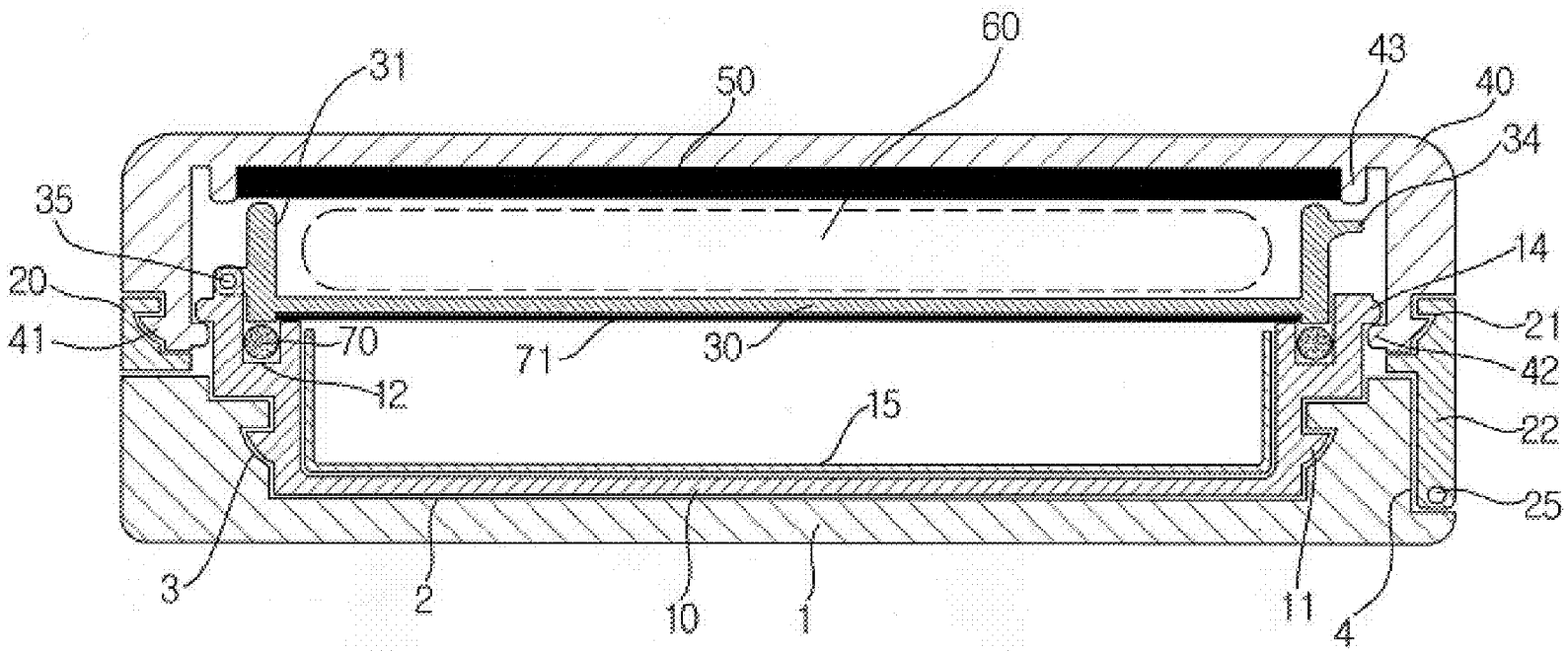

COSMETICS CASE HAVING STRUCTURE OF DUAL SEAL

TECHNICAL FIELD

The present invention relates, in general, to a cosmetics case having a dual sealing structure and, more particularly, to a cosmetics case having a dual sealing structure, which is capable of air-tightly sealing cosmetics contained in an inner case using a dual sealing structure that includes an inner lid, holding a makeup tool therein, and an outer lid having a mirror, thus preventing the cosmetics from being deteriorated or drying, and allowing the cosmetics to be more reliably stored.

BACKGROUND ART

Generally, a cosmetics case is designed to receive cosmetics, a makeup tool, and a mirror therein, thus allowing a user to put on makeup anywhere.

The cosmetics stored in the cosmetics case contain a volatile solvent. Thus, unless the cosmetics case storing the cosmetics is air-tightly sealed, the cosmetics are apt to deteriorate, so that the use of the cosmetics may be impossible. Therefore, the development of a cosmetics case having superior sealing ability is urgently needed.

Korean U.M. Registration No. 0431983 discloses an apparatus for opening and closing a lid of a cosmetics case having an air-tight sealing structure. According to the cited document, the cosmetics case includes a main body and an outer lid. The main body includes an inner case for holding cosmetics therein, a vinyl cover, and a puff. The outer lid is hinged at one end thereof to the upper portion of the main body, with a push button provided at a position opposite the hinge part. By pushing the push button, a locking protrusion is locked to or released from a locking hole of a core, so that the lid is closed or opened. In this case, liquid rubber in a gel state fills and hardens in a groove which is formed along the upper surface of a support body provided outside the inner case. Thereby, a rib of the outer lid comes into close contact with the hard rubber, thus air-tightly sealing the cosmetics case. Further, an actuating projection protrudes from the front of the push button. Thus, when the locking protrusion is removed from the locking hole of the core by pushing the push button, the actuating projection pushes up the core.

The conventional cosmetics case having the sealing structure is constructed so that the rib of the outer lid comes into close contact with the hard rubber of the inner lid, thus air-tightly sealing a gap between the outer lid and the inner lid. However, such a sealing structure is problematic in that, when the hard rubber loses its elasticity after repeated compressions of the rib, a gap is inevitably formed, so that air-tight sealing ability is lowered or lost.

Moreover, if one of the push button, the locking protrusion, the core, and the actuating projection, which constitute the locking structure of the conventional cosmetics case, is broken or damaged, the locking structure cannot be used at all. Consequently, the cosmetics case must be discarded. As such, the conventional cosmetics case is problematic in that its durability is low.

DISCLOSURE

Technical Problem

Accordingly, the present invention has been made keeping in mind the above problems occurring in the prior art, and an object of the present invention is to provide a cosmetics case having a dual sealing structure, which is capable of air-tightly sealing cosmetics contained in an inner case using a dual sealing structure, which includes an inner lid holding a makeup tool therein and an outer lid having a mirror, thus preventing the cosmetics from being deteriorated or drying, and allowing the cosmetics to be more reliably stored, therefore maximizing the durability of the cosmetics case.

Technical Solution

In order to accomplish the above object, the present invention provides a cosmetics case having a dual sealing structure, including an outer case having a cylindrical receiving chamber, with a fastening groove circumferentially provided in an inner circumference of the receiving chamber; an inner case received in the receiving chamber in such a way that a fastening step, provided on an outer circumference of the inner case, is inserted into the fastening groove of the outer case, and having a packing groove which is formed along an upper end of the inner case and receives a packing, with a plurality of locking guides provided on an upper portion of an outer circumference of the inner case; an inner lid rotated around a second hinge pin which is provided at a predetermined position on the upper end of the inner case, thus opening or closing the inner case, a lower end of the inner lid coming into close contact with the packing so as to air-tightly seal the inner case; a rail case mounted to an upper end of the outer case, a hinge block of the rail case being inserted into a hinge seat of the outer case so that the rail case is rotated around a first hinge pin, with a rail groove being circumferentially provided in an inner circumference of the rail case; and an outer lid having a rail step which is provided on a lower portion on an outer circumference thereof and rotates along the rail groove, and having a projection which is provided on an inner circumference of the outer lid and is guided along a corresponding locking guide, thus opening or closing a holding space of the inner lid.

Advantageous Effects

A cosmetics case according to the present invention, which is constructed as described above, can air-tightly store cosmetics, thus preventing the cosmetics from being deteriorated or drying, therefore maximizing the life of the cosmetics.

DESCRIPTION OF DRAWINGS

FIG. 1 is an exploded perspective view illustrating a cosmetics case having a dual sealing structure, according to the first embodiment of the present invention;

FIG. 2 is a sectional view illustrating the cosmetics case having the dual sealing structure, according to the first embodiment of the present invention; and FIG. 3 is a sectional view illustrating a cosmetics case having a dual sealing structure, according to the second embodiment of the present invention.

MODE FOR INVENTION

Hereinafter, the preferred embodiments of the present invention will be described in detail with reference to the accompanying drawings.

According to the first embodiment of the present invention, as shown in FIGS. 1 and 2, a cosmetics case includes an outer case 1, an inner case 10 which is received in a receiving chamber 2 of the outer case, an inner lid 30 which rotates around a second hinge pin 35 to open or close the inner case 10, a rail case 20 which is mounted to the upper end of the outer case 1 in such a way as to rotate around a first hinge pin 25, and an outer lid 40 which is rotatably coupled to the rail case 20 and opens or closes a holding space 31 in the inner lid 30.

In this case, the outer case 1 has a cylindrical or polyhedral shape, with the receiving chamber 2 defined in the outer case. A fastening groove 3 is circumferentially provided in the middle portion of the inner circumference of the receiving chamber 2.

Further, a fastening step 11 is circumferentially provided in the middle portion of the outer circumference of the inner case 10, which is inserted into the receiving chamber 2 of the outer case 1. The fastening step is press-fitted into the fastening groove 3, thus preventing the inner case from idly rotating or being removed from the receiving chamber.

A packing groove 12 is provided in the upper end of the inner case 10, so that a packing is inserted into the packing groove, thus ensuring the air-tightness of the inner case. A cosmetics storage container 15 is held in the inner case.

In particular, a plurality of locking guides 14 is provided on the outer circumference of the inner case 10, which protrudes upwards from the outer case 1, in such a way that they are spaced apart from each other at regular intervals. As shown in FIG. 2, the locking guides function to guide projections 42, according to the rotating direction of the outer lid 40, thus closing or opening the outer lid.

In other words, the locking guides 14 are provided on the outer circumference of the inner case 10 in such a way as to extend a long length. The lower surface of each locking guide 14, which guides the corresponding projection 42, is inclined, thus guiding the projection 42 upwards or downwards. A locking step 14-1 is provided at a predetermined position on each locking guide, along which the corresponding projection is guided, thus maintaining a locked state.

Further, the inner lid 30 is mounted to the upper end of the inner case 10 in such a way as to rotate around the second hinge pin 35, thus opening or closing the inner case.

The inner lid 30 is provided with the holding space 31 for holding a makeup tool 60, such as a puff. When the inner lid rotates around the second hinge pin 35 to close the inner case 10, the lower end of the inner lid comes into close contact with the packing 70 in the packing groove 12, thus perfectly air-tightly sealing the interior of the inner case.

Further, the rail case 20, which is mounted to the upper end of the outer case 1, has on an end thereof a hinge block 22. The hinge block is inserted into a hinge seat 4, which is provided in the outer portion of the outer case 1 in such a way as to rotate around the first hinge pin 25.

Furthermore, a rail groove 21 is circumferentially provided in the inner circumference of the rail case 20.

In addition, a mirror 50 is attached to the central portion of the inner surface of the outer lid 40 via an elastic rim 43. A rail step 41 is provided on the lower portion of the outer circumference of the outer lid to correspond to the rail groove 21 in the rail case 20.

The rail step 41 is inserted into the rail groove 21 in such a way as to move up and down and rotate, and is guided along the rail groove when the outer lid 40 is rotated. The projections 42 are provided on the inner circumference of the outer lid 40 to correspond to the locking guides 14 of the inner case 10.

The cosmetics case of this invention, which is constructed as described above, is operated as follows. When the locked outer lid 40 is turned counterclockwise, the rail step 41 of the outer lid rotates idly along the rail groove 21.

At this time, the projections 42 of the outer lid 40 pass over the corresponding locking steps 14-1, and move upward along the inclined surfaces of the locking guides 14. After the projections disengage from the locking guides, the outer lid rotates around the first hinge pin 25, thus opening the cosmetics case.

After the cosmetics tool 60 is taken out from the holding space 31 of the inner lid 30, the inner lid is rotated around the second hinge pin 35 using a handle 34, so that the inner case is opened.

Meanwhile, when a user desires to close the cosmetics case of this invention, the closing operation is performed in an order opposite the order of opening the cosmetics case. First, the user holds the handle 34 and rotates the inner lid 30 around the second hinge pin 35, thus closing the inner case 10. Afterwards, the used cosmetics tool 60 is put into the holding space 31.

Next, the outer lid 40 rotates around the first hinge pin 25 to close the holding space 31. Thereafter, when the outer lid is turned clockwise, the rail step 41 of the outer lid idly rotates along the rail groove 21.

At this time, each projection 42 of the outer lid 40 moves downwards along the inclined surface of the corresponding locking guide 14, and passes over the associated locking step 14-1. Thereby, the operation of locking the outer lid is completed. While the outer lid is locked in this way, the outer lid moves slowly downwards. Hence, the mirror 50 presses the inner lid 30, and the protruding surface provided on the bottom of the inner lid is compressed against the packing 70, which has a rectangular cross-section. Thereby, the interior of the inner case 10 is completely isolated from the exterior.

Meanwhile, as shown in FIG. 3, a packing 70 inserted into the packing groove 12 of the inner case 10 may have a circular cross-section. Further, a foam pad 71 may be attached to the lower surface of the inner lid 30. In this case, when the inner lid is closed, the inner lid is slowly pressed by the outer lid 40, so that the foam pad primarily comes into close contact with the upper surface of the inner case 10. Secondarily, the lower protruding surface of the inner case comes into close contact with the packing 70. Therefore, the dual sealing structure for the inner case is realized.

Further, the rail groove 21, which is circumferentially formed on the inner circumference of the rail case 20, may have a support step for supporting the rail step 41 of the outer lid 40.

In brief, the cosmetics case according to the present invention is constructed so that the outer lid 40 is rotated along the locking guides 14 of the inner case 10, and thus the cosmetics case is opened or closed. Further, the inner case is sealed through the dual sealing structure of the outer lid and the inner lid 30 using the packing 70 and the foam pad 71. Thus, air-tight sealing ability is further improved, thus preserving cosmetics for a longer period of time and increasing durability compared to the conventional cosmetics case.

INDUSTRIAL APPLICABILITY

As described above, the present invention provides a cosmetics case having a dual sealing structure, which is capable of air-tightly sealing cosmetics contained in an inner case using a dual sealing structure, which includes an inner lid holding a makeup tool therein and an outer lid having a mirror, thus preventing the cosmetics from being deteriorated or drying, allowing the cosmetics to be more reliably stored, and maximizing the durability of the cosmetics case, therefore being adaptable to all cosmetics cases.

The invention claimed is:

1. A cosmetics case having a dual sealing structure, comprising:

an outer case (1) having a cylindrical receiving chamber (2), with a fastening groove (3) circumferentially provided in an inner circumference of the receiving chamber (2);

an inner case (10) received in the receiving chamber (2) in such a way that a fastening step (11), provided on an outer circumference of the inner case, is inserted into the fastening groove (3) of the outer case (1), and comprising a packing groove (12) which is formed along an upper end of the inner case and receives a packing (70), with a plurality of locking guides (14) provided on an upper portion of an outer circumference of the inner case;

an inner lid (30) rotated around a second hinge pin (35) which is provided at a predetermined position on the upper end of the inner case (10), thus opening or closing the inner case (10), a lower end of the inner lid coming into close contact with the packing (70) so as to airtightly seal the inner case (10);

a rail case (20) mounted to an upper end of the outer case (1), a hinge block (22) of the rail case being inserted into a hinge seat (4) of the outer case (1) so that the rail case is rotated around a first hinge pin (25), with a rail groove (21) being circumferentially provided in an inner circumference of the rail case (20); and an outer lid (40) comprising a rail step (41) which is provided on a lower portion on an outer circumference thereof and rotates along the rail groove (21), and comprising a projection (42) which is provided on an inner circumference of the outer lid and is guided along a corresponding locking guide, thus opening or closing a holding space (31) of the inner lid (30).

2. The cosmetics case according to claim 1, wherein each of the locking guides (14) further comprises a locking step (14-1) so as to maintain a locked state of the projection (42).

3. The cosmetics case according to claim 1, wherein a foam pad (71) is attached to a lower surface of the inner lid (30) in such a way as to come into close contact with the upper end of the inner case (10).

* * * * *